United States Patent [19]

Goodfellow

[11] Patent Number: 4,610,318

[45] Date of Patent: Sep. 9, 1986

[54] ROTARY CUTTER ASSEMBLY

[76] Inventor: Robert D. Goodfellow, Meadowbrook Ter., Bedford, Pa. 15522

[21] Appl. No.: 580,368

[22] Filed: Feb. 15, 1984

[51] Int. Cl.[4] ..... E21B 10/20

[52] U.S. Cl. ..... 175/339; 175/342; 175/382; 175/412

[58] Field of Search ..... 175/258, 382, 337, 339, 175/342, 340, 366, 367, 368, 369, 412

[56] References Cited

U.S. PATENT DOCUMENTS

| | | | |
|---|---|---|---|
| 2,065,743 | 12/1936 | Reed | 175/366 |
| 2,648,526 | 8/1953 | Lanchester | 175/366 |
| 3,139,946 | 7/1964 | Bronson | 175/412 |
| 3,463,256 | 8/1969 | White | 175/412 |
| 4,158,973 | 6/1979 | Schumacher, Jr. et al. | 175/342 |
| 4,335,794 | 6/1982 | Goodfellow | 175/337 |
| 4,359,113 | 11/1982 | Morris | 175/337 |

*Primary Examiner*—Stephen J. Novosad
*Assistant Examiner*—William P. Neuder
*Attorney, Agent, or Firm*—Prutzman, Kalb, Chilton & Alix

[57] ABSTRACT

A rotary cutter assembly comprises a drill head having a plurality of receptacles which releasably receive rolling cutter bit assemblies. The bit assemblies are locked in position by a locking sleeve connecting transverse fluid passageways of the drill head and bit assembly. Radially locking means in the form of pins received in complementary slots parallel to the rotational axis of the rotary cutter assembly are also provided.

16 Claims, 3 Drawing Figures

ROTARY CUTTER ASSEMBLY

BACKGROUND OF THE INVENTION

This invention relates to rotary cutter assemblies of the type employed in earth boring applications and more particularly, this invention relates to rotary cutter assemblies employing rotary cone cutters for drilling wells, blastholes and the like.

Rotary cutter assemblies employing multiple rolling cutters which rotate relative to multiple axes of rotation in cooperating fashion to drill earth and hard rock formations are well known in the art. Many such prior art assemblies employ bit assemblies having legs or connector structures which carry the rolling cutters. Such cutter assemblies also provide means for conducting a flushing fluid from the drill string through the cutter assembly to the bottom of the drill hole. The heavy duty work environment for the rotary cutter assembly dictates that the assemblies be manufactured to incorporate a high degree of structural integrity. Conventionally, the connector structures and cutters are preassembled at a manufacturing location and permanently welded together to provide a rotary cutter assembly of an integral form which is then coupled to the drill string of the drill rig.

In the environment to which the rotary cutter assembly of the present invention is ordinarily subjected, adverse environmental conditions such as dirt, dust, shock, heat, and vibration frequently result in uneven wear or breakage of the multiple rolling cutters or the connector structures which constitute the drill bit assembly. It is not uncommon for one of the rolling cutters of the rotary cutter assembly to become non-functional, while the other rolling cutters of the assembly remain in functional condition. However, because the rotary multiple cutters operate in a cooperating fashion, an entire rotary cutter assembly may become non-functional due to either breakage or the wear of a single multiple cutter or portion thereof or of a single connector structure.

Recent attempts to ameliorate the harsh consequences of replacing an entire defective rotary cutter assembly have been directed to providing a rotary cutter having multiple components each of which can be readily replaced in the field. For example, in U.S. Pat. No. 4,335,794 issued to Robert D. Goodfellow, the inventor herein, and entitled "Rotary Cone Cutter", a multi-cone roller bit is disclosed wherein the rotary cone cutter is provided with individual releasable legs that permit replacement of a single defective rolling cutter unit without the requirement that the entire rotary cutter assembly be replaced. All of the releasable legs of U.S. Pat. No. 4,335,794 are clamped to a pot member by a single plug member so that all of the rolling cutter units are essentially clamped in place or released substantially simultaneously. The present invention is a new and improved rotary cutter assembly which provides improved means for efficiently replacing a rolling cutter unit of a cutter assembly on an individual basis, and also incorporates new and improved features relative to a fluid flushing system and desirable features of prior art rotary cutter assemblies.

BRIEF SUMMARY OF THE INVENTION

Briefly stated, the rotary cutter assembly of the present invention in a preferred form comprises a drill head which is adapted at the upper portion for coupling to a drill string. The drill head has at its lower portion a plurality of receptacles. Each of the receptacles is defined between a pair opposing walls and a downwardly facing transverse abutment surface. The drill head is further provided with a central longitudinal fluid passageway for transporting flushing fluid for the drill bit assembly. The longitudinal fluid passageway communicates with a plurality of first transverse fluid passageways which open into each of the receptacles. A bit assembly comprises a shank which is releasably received in one of the receptacles. The bit assembly also comprises a cutter means rotatably mounted to the shank and a bearing means intermediate the shank and cutter means. The shank has a transverse fluid passageway which communicates with a bearing passageway leading to the bearing means. A first locking means secures the shank between the pair of opposing walls of the drill head. A second locking means secures the bit assembly to the drill head by connecting the transverse fluid passageways of the drill head and the shank of the bit assembly.

In a preferred form, the first locking means employs a pair of pins which are received in complementary slots between the receptacle walls and the shank. The second locking means comprises an internally threaded locking sleeve which is inserted through the transverse passageway of the shank of the drill bit assembly. The end of the transverse passageway is then sealed by means of an air plug and a snap-ring. The drill head may further receive a perforated tube which is employed to filter contaminants from the longitudinal fluid passageway.

An alternate embodiment of the invention employs locking means for securing the bit assembly to the drill head comprising a pair of locking pins securing the bit assembly radially relative to the central rotational axis of the assembly and a locking pin connecting the bit assembly and drill head transversely relative to the central axis.

An object of the invention is to provide a new and improved rotary cutter assembly that can be partially disassembled in the field to replace a rolling cutter unit.

An object of the invention is to provide a new and improved rotary cutter assembly having improved means for removably securing a plurality of bit assemblies to a drill head without compromising the structural integrity of the cutter assembly.

Another object of the invention is to provide a new and improved rotary cutter assembly wherein a single cutter unit can be secured in position or removed from the assembly independently of the other cutter units.

A further object of the invention is to provide a new and improved rotary cutter assembly having a new and improved filter system for filtering contaminants from the flushing fluid.

A still further object of the invention is to provide a new and improved rotary cutter assembly of sturdy construction which can be relatively easily assembled and disassembled in the field.

Other objects and advantages of the invention will become apparent from the detailed description and the drawings.

DETAILED DESCRIPTION OF THE DRAWINGS

Figure 1:
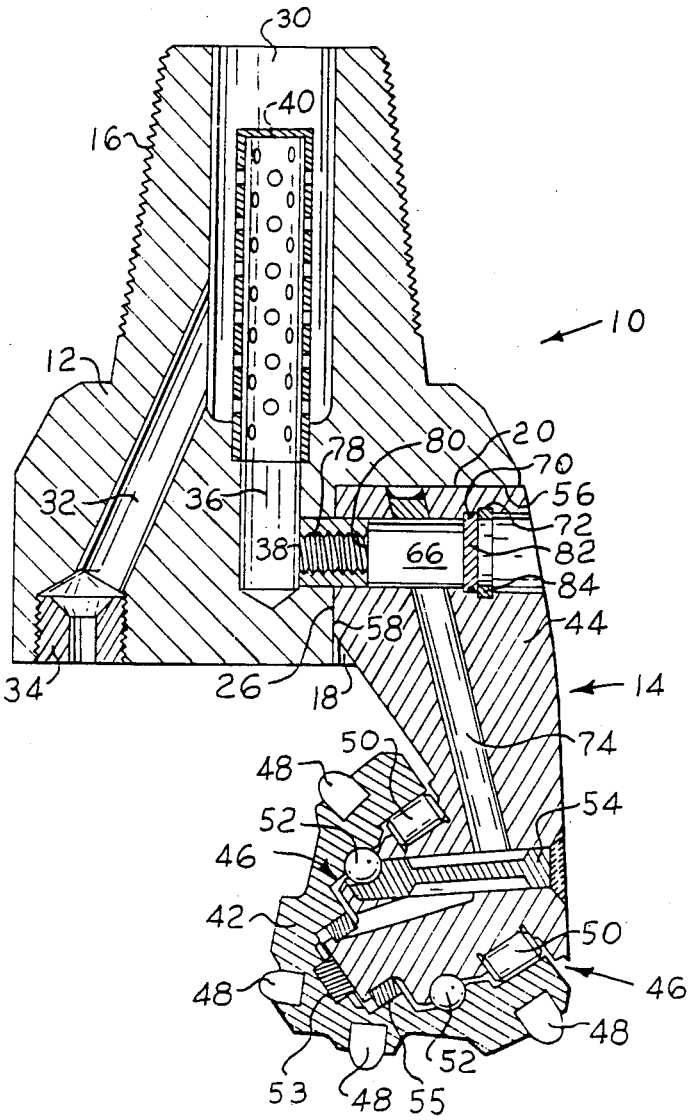
FIG. 1 is a front sectional view of a rotary cutter assembly of the present invention, incorporating a single bit assembly unit.
Figure 3:
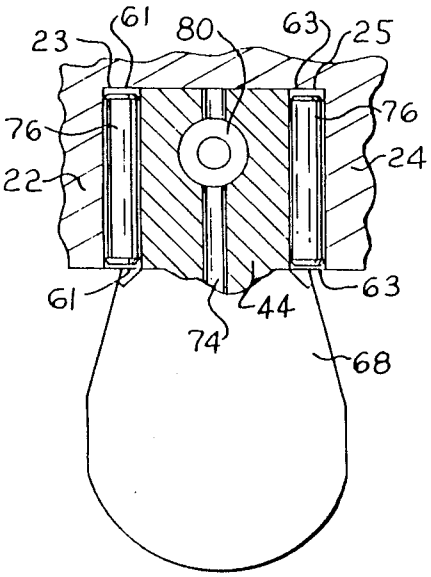
FIG. 3 is a side view of a portion of the rotary cutter assembly of FIG. 1, partly broken away to show detail.

With reference to the drawings wherein like numerals represent like parts throughout the drawings, a rotary cutter assembly 10 comprises a drill head shown generally as 12 and a plurality of drill bit assemblies 14 (only one of which is shown in FIG. 1).

Figure 2:
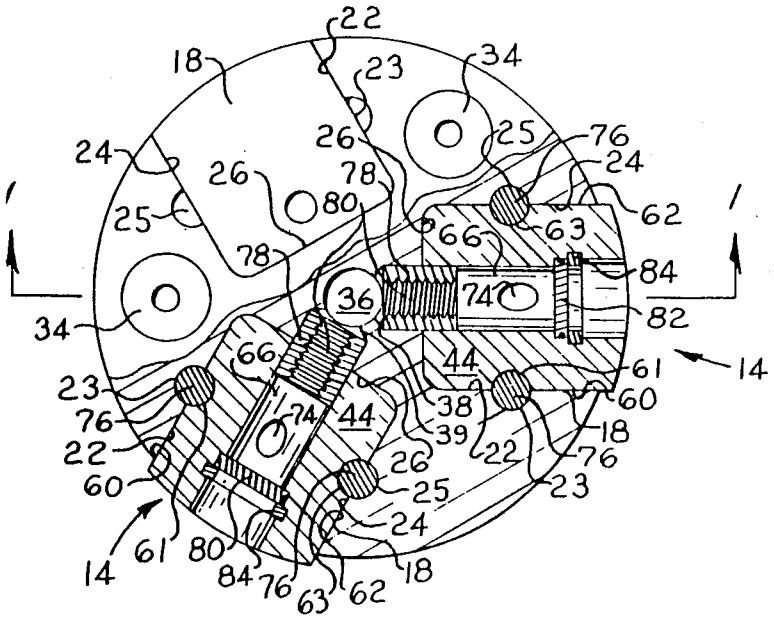
FIG. 2 is partly a cross-sectional view and partly a bottom end view of the rotary cutter assembly of FIG. 1 incorporating two bit assembly units.

Drill head 12 is adapted at the upper portion for attachment to the lower end of a drill string (not shown). A threaded portion 16 is provided to facilitate the attachment to the drill string. Drill head 12 may be generally described as a tapered cylindrical member flaring at a lower portion to a coupling structure of enlarged diameter, and generally exteriorly symmetrical about a central axis of rotation. At the lower peripheral portion of drill head 12, a plurality of circumferentially spaced receptacles 18 are symmetrically located (as shown in FIG. 2). The receptacles are adapted to receive a drill bit assembly 14 as will be described below. In a preferred form, the drill head has three equally spaced receptacles.

In a preferred form, each receptacle 18 is of a substantially rectangular form having slightly rounded edges and an exterior boundary of a slight curvature. With reference to FIG. 1, each receptacle 18 opens radially outwardly and axially downwardly relative to the rotational axis of drill head 12. Receptacle 18 is defined at the top by a downwardly facing transverse abutment surface 20 of drill head 12. Receptacle 18 is further defined by a pair of opposing walls 22 and 24 which extend in a substantially vertical orientation as shown in FIG. 1. Interposed between walls 22 and 24 is an inner engagement surface 26. Wall 22 and 24 are further each provided with an opposing slot 23 and 25, respectively, which extend in a vertical orientation parallel to the central rotational axis of drill head 12.

A longitudinal tubular passageway 30 generally symmetric about the rotational axis of drill head 12 is part of fluid flushing system which is provided to transport flushing fluid from the drill string through the rotary cutter assembly to the bottom of the hole being drilled. Passageway 30 obliquely communicates with a plurality of passageways 32 (only one of which is shown). Passageway 32 conducts flushing fluid to a nozzle 34 for a pressurized injection of a flushing fluid into the bottom of the drill hole in a fashion which provides for forcing the cuttings away from the hole bottom, up the bore, and away from the drill string. Longitudinal passageway 30 further comprises at a lower portion a transition passageway 36 of reduced diameter. Passageway 36 communicates with a plurality of substantially transverse passageways 38, each of which open into a corresponding receptacle through engagement surface 26.

The flushing fluid system functions to provide a lubrication system for the rotary cutter assembly. A filter means is provided in the longitudinal passageway 30 for filtering contaminants from the flushing fluid system. In a preferred form, the filter means comprises a perforated tube 40, the lower end of which is received at the upper end of transition passageway 36 so that tube 40 extends upwardly into passageway 30. For a drill bit assembly which employs a sealed bearing assembly a suitable grease cup would be employed rather than tube 40. The lubrication system would provide grease lubrication to the bearing assembly by means of hydrostatic pressure acting on the grease cup.

Bit assembly 14 generally comprises a roller cutter 42 rotatably joined to a shank 44. Roller cutter 42 comprises a substantially conically shaped roller cutter shell carrying a plurality of cutter teeth 48 formed of tungsten, carbide or steel or other durable material and rigidly implanted into the shell.

A bearing assembly 46 includes a plurality of roller bearings 50 and ball bearings 52 which are permanently located at the rotational interface between roller cutter 42 and shank 44. The ball bearings are inserted into the ball bearing race via a bore which receives a bearing pin 54 which is then suitably held in place as by welding. A thrust bearing 53 and a sleeve bearing 55 are rotatable with cutter 42.

Shank 44 is contoured at the upper portion thereof as shown in FIG. 1 so that the shank is closely received in receptacle 18. Shank 44 therefore comprises an upper abutment surface 56, an inner engagement surface 58, and opposing walls 60 and 62. Each of opposing walls 60 and 62 further includes a slot 61 and 63, respectively, which slots 61 and 63 are dimensioned and located to be complementary to corresponding slots 23 and 25 of the drill head 12 so that when the shank is received in receptacle 18, slot 23 aligns with slot 61 and slot 25 aligns with slot 63.

Shank 44 is further provided with a transverse passageway 66 which extends from engagement surface 58 outwardly through exterior surface 68 of the shank. Transverse passageway 66 is further provided at the outer portion with two circumferential slots 70 and 72. A fluid passageway 74 obliquely communicates with transverse passageway 66 and leads to the bearing assembly 46. The fluid passageway 74 conveys compressed air to the bearing assembly to provide a means for freeing the bearings from particulate matter generated by the cutting action of the roller cutters.

A bit assembly 14 is rigidly locked into a receptacle 18 by means of a pair of opposing pins 76, each of which is received in opposite recesses formed by opposed complementary slots 23 and 61 and slots 25 and 63. Each of slots 61 and 63 terminates at a lower retaining shoulder which acts to retain the pins in the recesses. The pins 76 are preferably solid cylindrical members which upon reception in the recesses as previously described are oriented so that the longitudinal axes of pins 76 are substantially parallel to the axis of rotation of drill head 12. The pin slot locking arrangement thus secures the bit assembly 14 in a fixed radial position relative to drill head 12.

A second locking mechanism to secure the bit assembly 14 in receptacle 18 in a fixed axial position relative to drill head 12 is provided by locking sleeve 78 which is inserted through transverse passageway 66 so that the locking sleeve is seated in both transverse passageway 36 and transverse passageway 66. It is noted that the latter two passageways are dimensioned to have adjacent portions of equal diameters, and such passageways also are in alignment when the shank is received in the receptacle as described above. Locking sleeve 78 is also provided with an internal passageway defined by an internal threaded region 80. Threaded region 80 provides an engagement surface so that the locking sleeve 78 may be threadably engaged by a tool inserted through transverse passageway 66. Locking sleeve 78 may be forceably removed through the passageway 66 to release the locking means so that the shank 44 may be easily removed from the drill head 12.

The passageway defined by the locking sleeve provides a fluid passageway so that compressed air may communicate with the passageway 74 to provide compressed air to the bearing assembly as previously described. After the locking sleeve 78 is mounted in place, an air plug 82 is inserted into circumferential slot 70 and secured therein by means of snap-ring 84 inserted into adjacent circumferential slot 72. The air plug 82 seals transverse passageway 66 to prevent compressed air from being forced outwardly through the end of the passageway at the exterior shank surface 68. The foregoing described bit assembly and the locking and reception of same into receptacle 18 is essentially identical for each bit assembly 14 of the drill assembly. In a preferred form of the invention, three receptacles are provided in drill head 12 and three bit assemblies substantially identical to that previously described are each received in a receptacle and locked in place, as described above.

The foregoing described locking means provides a means for securely locking the bit assembly to the drill head while at the same time providing a means for relatively easily removing a drill bit assembly in the field should it become necessary to replace one or more such assemblies. Each drill bit assembly may be locked to the drill head and/or removed from the drill head independently of the other bit assemblies. To remove a drill bit assembly from a drill head 12, the snap-ring 84 and air plug 82 can be relatively easily removed and a tool having a threaded end is inserted to engage the threaded region 80 of locking sleeve 78. Locking sleeve 78 is then pulled through transverse passageway 66 and removed from the assembly. Locking pins 76 may be removed from the assembly with the removal of the shank 44 from receptacle 18. A new bit assembly can then be easily mounted to the drill head by inserting the pins 76 in the corresponding recesses and inserting the locking sleeve 78 through a transverse passageway 66 to seat same securely in place, thus, also connecting the fluid passageways of the drill head and the drill bit assembly. The air plug and snap-ring are then inserted into passageway 66 and snapped into place.

In an alternate embodiment of the invention pins 76 may be integrally formed or permanently attached to shank 44 at the location of slots 61 and 63 or permanently attached to drill head 12 at the location of slots 23 and 25. The first locking means in the latter embodiment essentially comprises a pair of tongue and groove type engagements for securing the bit assembly radially relative to the drill head.

Alternately a locking pin may be employed in place of locking sleeve 78 and secured in aligned transverse bores of the shank and drill head to secure the bit assembly axially relative to the drill head. The transverse locking pin may be secured in position by welding the pin to the shank.

The foregoing description is set forth for purposes of illustrating a preferred form of the invention and should not be deemed a limitation thereof. Accordingly, various modifications, adaptations, and alternative embodiments of the invention may occur to those skilled in the art.

What is claimed is:

1. A rotary cutter assembly, comprising:

a drill head adapted at an upper portion thereof for coupling to a drill string and having at a lower portion thereof a plurality of receptacles, each defined between a pair of opposing walls, said head having a longitudinal fluid passageway communicating with a first transverse passageway opening into each said receptacle;

at least one bit assembly comprising a shank releaseably received in one said receptacle, a cutter means, and a bearing means intermediate said shank and cutter means, said shank having a second transverse passageway communicating with a bearing passageway leading to said bearing means;

first locking means to secure said shank between said pair of opposing walls; and second locking means connecting said transverse passageways to secure said bit assembly to said head.

2. The rotary cutter assembly of claim 1 wherein said walls and said shank have opposed complementary slots and said first locking means comprises a pair of pins received in said slots.

3. The rotary cutter assembly of claim 1 wherein said second locking means comprises a locking sleeve.

4. The rotary cutter assembly of claim 1 wherein said drill head further receives a filter means to filter contaminants from the longitudinal passageway.

5. The rotary cutter assembly of claim 4 wherein the filter means comprises a perforated tube.

6. The rotary cutter assembly of claim 1 wherein each said receptacle is a substantially rectangular recess opening axially and radially at the lower periphery of said drill head.

7. The rotary cutter assembly of claim 6 wherein each said receptacle is further defined by a downwardly facing abutment surface and said shank is closely received in said receptacle, said shank and receptacle having complementary transverse abutment surfaces.

8. The rotary cutter assembly of claim 1 wherein the number of receptacles and the number of bit assemblies is three.

9. A rotary cutter assembly, comprising:

a drill head adapted at an upper portion thereof for coupling to a drill string and having at a lower portion thereof a receptacle means having a pair of opposing slots, said drill head including a first fluid passageway means opening through said receptacle means;

a bit assembly comprising a shank received by said receptacle means, a cutter means, and a second fluid passageway means, said shank having a pair of opposing slots alignable and complementary with said receptacle means slots and being releasably received in said receptacle means and secured thereto by a locking sleeve connecting said first and second fluid passageway means so that said first and second fluid passageway means cooperate to provide a fluid passageway means to lubricate said bit assembly, and a pair of pins received in said complementary slots of said shank and receptacle means.

10. The rotary assembly of claim 9 wherein said first fluid passageway means comprises a central longitudinal portion and said first and second fluid passageway means comprise connectable passageway portions in substantially transverse relationship to the longitudinal passageway portion.

11. The rotary cutter assembly of claim 10 wherein the shank is further adapted so that the locking sleeve may be removably inserted through the transverse portion of the second fluid passageway.

12. The rotary cutter assembly of claim 11 wherein the shank is further provided with air plug means to removably seal an outer end of the second transverse passageway portion.

13. A rotary cutter assembly, comprising:

a drill head adapted at an upper portion thereof for coupling to a drill string and having at a lower portion thereof a plurality of receptacles, each defined between a pair of opposing walls, said head having a longitudinal fluid passageway communicating with a first transverse passageway opening into said receptacle;

at least one bit assembly comprising a shank releasably received in one said receptacle, a cutter means, and a bearing means intermediate said shank and cutter means, said shank having a second transverse passageway communicating with the fluid passageway leading to said bearing means;

first locking means to secure said shank between said pair of opposing walls; and second locking means connecting said transverse passageways to secure said bit assembly to said head, said second locking means comprising a locking sleeve having an internal threaded portion defining an interior passageway.

14. The rotary cutter assembly of claim 13 wherein said second transverse passageway extends through opposite sides of the shank.

15. The rotary cutter assembly of claim 14 further comprising a removable plug means to seal an end of the second transverse passageway.

16. The rotary cutter assembly of claim 15 wherein said plug means comprises an air plug secured in the second transverse passageway by a snap ring.

* * * * *